US007954670B2

(12) United States Patent
Stuart

(10) Patent No.: US 7,954,670 B2
(45) Date of Patent: Jun. 7, 2011

(54) CONTAINER EVACUATION SYSTEM

(75) Inventor: Kevin R. Stuart, Des Moines, IA (US)

(73) Assignee: Plastic Systems, Inc., Des Moines, IA (US)

( * ) Notice: Subject to any disclaimer, the term of this patent is extended or adjusted under 35 U.S.C. 154(b) by 802 days.

(21) Appl. No.: 11/810,898

(22) Filed: Jun. 7, 2007

(65) Prior Publication Data

US 2008/0302819 A1 Dec. 11, 2008

(51) Int. Cl.
*B65D 35/28* (2006.01)

(52) U.S. Cl. ..... 222/95; 222/105; 222/386.5; 383/107; 383/109

(58) Field of Classification Search ..... 222/95, 222/105, 386.5, 94; 383/109, 107
See application file for complete search history.

(56) References Cited

U.S. PATENT DOCUMENTS 3,822,806 A * 7/1974 Grimes ..... 215/11.3
3,936,334 A * 2/1976 Kushida et al. ..... 156/69
4,796,788 A * 1/1989 Bond ..... 222/105
5,096,092 A * 3/1992 Devine ..... 222/95
6,120,181 A * 9/2000 Wilcox ..... 383/109
6,234,351 B1 5/2001 Wilcox
6,627,873 B2 8/2002 Wilcox
6,467,652 B2 * 10/2002 Wilcox et al. ..... 222/95

* cited by examiner

*Primary Examiner* — Kevin P Shaver
*Assistant Examiner* — Jonathan Wood
(74) *Attorney, Agent, or Firm* — Brett Trout

(57) ABSTRACT

A container evacuation system is provided for viscous flowable materials such as grease, paste or flowable powders. The container system includes a lightweight, rigid exterior, such as a cardboard container. Provided within the container is a flexible containment system constructed of polyethylene sheets or the like. The flexible containment system is provided with a plurality of weldments to create at least two pockets, wherein one pocket contains the flowable material and a second pocket is available to be filled with air, to allow air provided to the second pocket to force the flowable material from the first pocket out through a drain. The system includes a weldment which curves around at least a portion of the drain to crease a funnel which focuses flowable material toward the drain, while reducing the likelihood of a portion of the flexible containment system from obstructing the movement of flowable material out of the first pocket through the drain.

2 Claims, 5 Drawing Sheets

CONTAINER EVACUATION SYSTEM

BACKGROUND OF THE INVENTION

1. Field of the Invention

The present invention relates to bulk containers for flowable materials and, more specifically, to a flexible bulk container system which allows for the more complete evacuation of a viscous material from a container.

2. Description of the Prior Art

It is known in the art when moving viscous material, such as grease and the like, to utilize a container having a rigid exterior frame and a flexible interior pocket. Typically the interior pocket contains a top mounted inlet and a side mounted drain. The pocket is filled from the top inlet, which is capped for transportation and storage. When it is desired to evacuate the container, the drain is opened and the material is allowed to flow out of the container through the drain.

When dealing with viscous materials such as grease, especially when the grease is cooled and thereby less flowable, it is desirable to provide a mechanism for forcing the grease from the container through the drain.

It is known in the art to provide a two-ply pocket having an inner pocket coupled to an outer pocket, such as that shown in U.S. Pat. Nos. 6,427,873 and 6,234,351, both of which are incorporated herein by reference. In such a construction, the inner pocket is welded or otherwise secured to the outer pocket along the exterior seams. The inner pocket and outer pocket are also welded to one another along one perpendicular line behind the inlet, and across another perpendicular line below the drain. The outer pocket is provided with a hose which allows for the pumping of air into the inner stice between the inner pocket and the outer pocket. As air is pumped into the inner stice, the air biases the inner pocket away from the outer pocket. The welds prevent the air from causing the inner pocket to cover a portion of the drain, thereby stemming the flow of material therethrough.

While such prior art constructions aid in the evacuation of viscous material such as grease and the like, such prior art pockets have certain drawbacks. One drawback associated with such prior art devices is that the straight weld between the inner pocket and outer pocket positioned below the drain frustrates complete evacuation of the flowable material from the portion of the pocket where the weld meets the edges of the inner pocket and outer pocket. An additional drawback associated with such prior art devices is that the failure of the system to more completely evacuate the flowable material at the points where the weld below the drain meets the edges of the inner pocket and outer pocket leads to the evacuation process taking an undesirably long time. Additionally, as most prior art evacuation systems are provided with a system for providing a vacuum around the drain, the additional time required to attempt to evacuate the flowable material leads to the increased likelihood that the pressure on the inner pocket will force a portion of the inner pocket across the drain opening, thereby stalling or at least substantially slowing the evacuation of the system. The difficulties encountered in the prior art discussed hereinabove are substantially eliminated by the present invention.

SUMMARY OF THE INVENTION

In an advantage provided by the present invention, a container evacuation system is provided which provides for more complete evacuation of a container of flowable material.

Advantageously, this invention provides a container evacuation system which evacuates a fluid material with increased efficiency.

Advantageously, this invention provides a container evacuation system which allows for faster evacuation of a flowable material from the container.

Advantageously, this invention provides a container evacuation system which is of a low-cost, lightweight manufacture.

Advantageously, this invention provides a container evacuation system which allows for the evacuation of highly viscous flowable materials.

Advantageously, this invention provides a container evacuation system which provides for higher recovery rate of liquid and semi-liquid products from a container.

Advantageously, this invention provides a container evacuation system which reduces clogging of an evacuation drain with container material during the evacuation process.

Advantageously, this invention provides a container evacuation system which allows for the heating of a liquid or semi-liquid product within the container to reduce viscosity and aid in the evacuation process.

Advantageously, this invention provides a container evacuation system which allows for more positive coupling of an air supply to a container to aid in the evacuation process, and to prevent tearing or ripping of the air supply line from the container.

In an advantage provided by this invention, a container system is provided with a flexible container in supporting engagement with a rigid frame. The flexible container includes a first flexible pocket coupled to a second flexible pocket. An inlet and drain are coupled to the first flexible pocket, and a fill port is connected to the second flexible pocket.

When it is desired to utilize the container, the first pocket is filled with a flowable material. When it is desired to evacuate the container, an air supply line is coupled to the fill port and the drain is opened. The air is pumped into the second flexible pocket, thereby forcing material out of the first flexible pocket through the drain. In a preferred embodiment, the first flexible pocket is secured to the second flexible pocket along a seam which angles around the drain to allow for more complete evacuation of the first flexible pocket.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
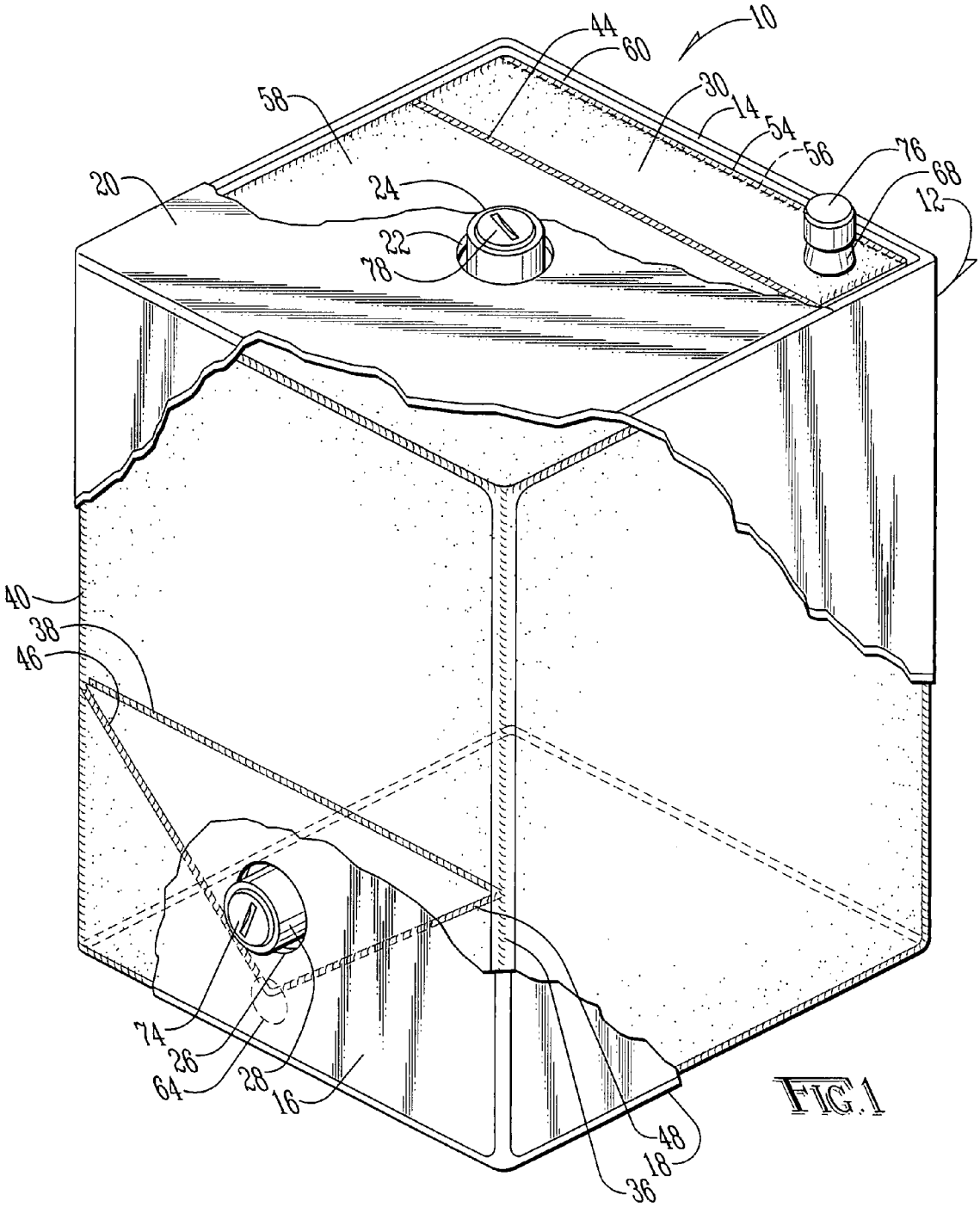
FIG. 1 illustrates a top perspective view of the container evacuation system of the present invention in partial cutaway and partial phantom in an expanded position.

A container evacuation system according to the present invention is shown generally as (10) in FIG. 1. The system (10) includes a rigid outer container (12) preferably constructed of multiple layers of corrugated cardboard (14). In the preferred embodiment the rigid container (12) is of a generally rectangular box construction. However, the rigid container (12) may be constructed of any suitable material, including, but not limited to, metal, fabric or other textile, and may be utilized in any desired configuration, such as octagonal, cylindrical, or any other desired configuration. In the preferred embodiment, the rigid container (12) may be of any desired volume but, in the preferred embodiment, is preferably between 0.5 and 10.0 cubic meters, and most preferably between 1.0 and 2.0 cubic meters.

The rigid outer container (12) is provided with a sidewall (16) coupled to a bottom (18) and a top (20). If desired, the top (20) may be removable and provided with a cutout (22) to accommodate an inlet (24). Alternatively, the rigid outer container (12) may be provided without a top (20). The sidewall (16) is preferably provided with circular opening (26) to accommodate a drain (28).

As shown in FIG. 1, provided within the rigid container (12) is a flexible containment system (30). In the preferred embodiment, the flexible containment system (30) includes three sheets (32), (33) and (34). Of course, any desired number of sheets may be provided to produce any desired number of pockets of any desired number of plys. While the sheets (32), (33) and (34) may be constructed of any desired flexible material, in the preferred embodiment, the sheets are constructed of polyethylene. The inner polyethylene sheets (32) and (33) are ninety micrometers thick and outer polyethylene sheet (34) is one hundred five micrometers thick. All three sheets (32), (33) and (34) are preferably two thousand three hundred sixty-five millimeters wide and four thousand seven hundred thirty millimeters long. The sheets are preferably laid on top of one another and then folded over before being welded together along three sides to produce a first seam created by a first weldment (36), a second seam created by a second weldment (38) and a third seam created by a third weldment (40).

At the folded side (42), the polyethylene sheets (32), (33) and (34) are not welded. The polyethylene sheets (32), (33) and (34) are welded together along a straight line weldment (44) extending from the weldment (36) to the weldment (40). However, whereas the weldments (36), (38) and (40) are across all six plys created by the folded polyethylene sheets (32), (33) and (34), the weldment (44) is merely a two-ply weldment between the top three layers of the polyethylene sheets (32), (33) and (34). Similarly, on the underside of the flexible containment system (30), a fourth seam is created by a fourth weldment (46) and a fifth seam is created by a fifth weldment (48). Extending from the weldment (38) to a point (50) in line with the drain (28). The weldments (46) and (48) are preferably only weldments between the three bottom layers of the polyethylene sheets (32), (33) and (34).

Figure 2:
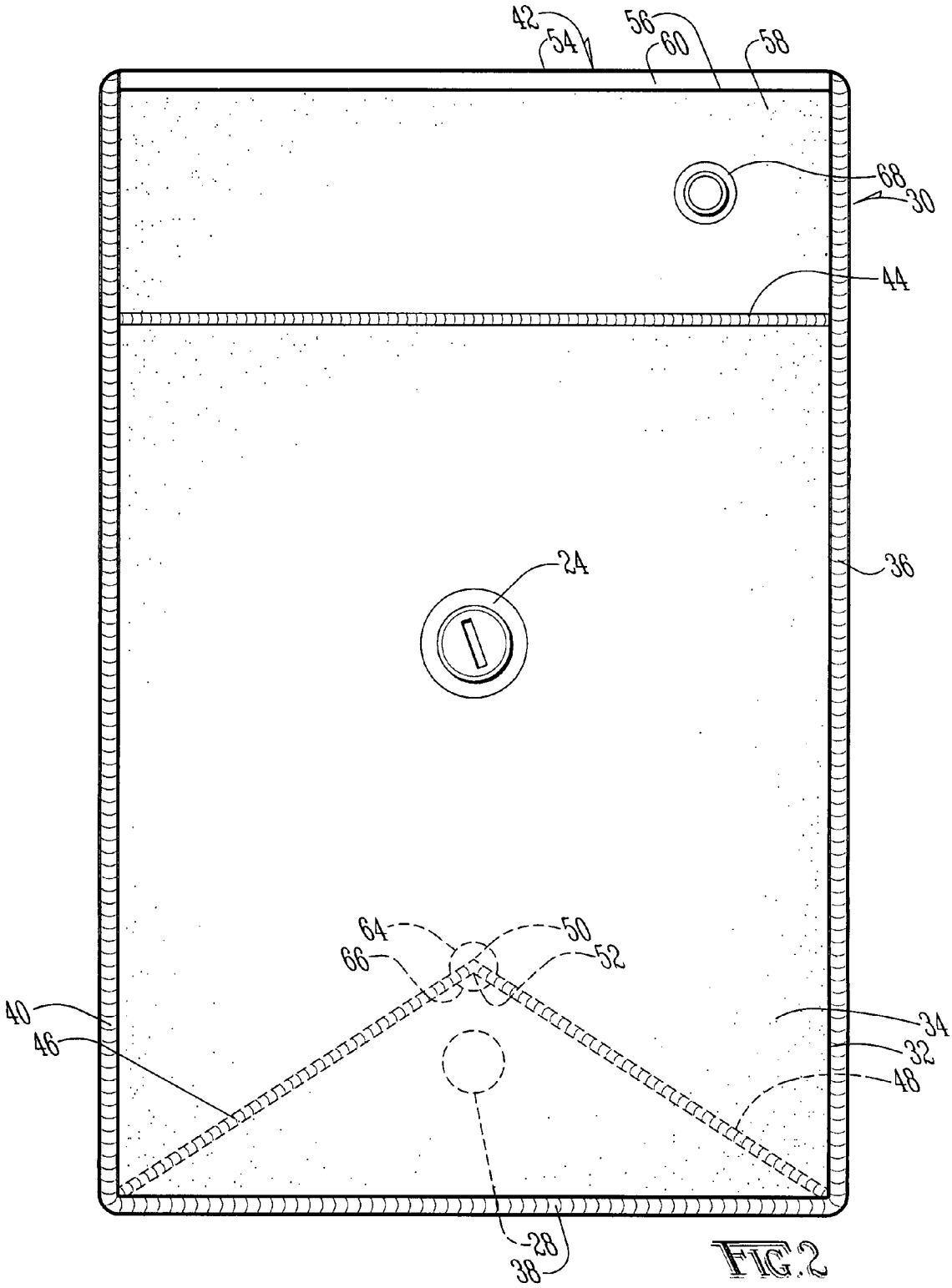
FIG. 2 illustrates a top elevation in partial phantom of the container pocket of the system of FIG. 1 in a flattened position.

As shown in FIG. 2, the weldments (46) and (48) preferably form an obtuse angle at the point (50). While it is preferable to provide an angle between the weldments (46) and (48) at least ninety degrees and, more preferably greater than ninety degrees, the angle (52) may be of any desired angle. If desired, the fourth weldment (46) and fifth weldment (48) may be coupled by an arcuate sixth weldment (not shown).

As shown in FIG. 1, the six-ply weldments (36), (38) and (40), the folds (54) and (56), and the three-ply weldments (44), (46) and (48) form a first two-ply pocket (58) and second single ply pocket (60). The first pocket (58) is designed to hold a flowable material (62), such as grease. In addition to grease, the system may be used for paste, liquid flowable powders, or any material for which it is desired to provide an evacuation assist. The second pocket (60) is designed to hold air (82).

In the preferred embodiment, the polyethylene sheets (32), (33) and (34), and weldments (36), (38), (40), (44), (46) and (48) are preferably designed to withstand a temperature in excess of ninety degrees Celsius, and more preferably, one hundred degrees Celsius to allow the flowable material (62), such as grease or the like, to be heated during filling and evacuation of the flexible containment system (30) to decrease the viscosity of the flowable material (62).

As shown in FIG. 2, provided around the point (50), where the weldments (46) and (48) meet, is a circular weldment (64). The circular weldment (64) is provided to allow a curved connection (66) between the weldments (46) and (48) to reduce the tendency of the flexible containment system (30) to tear at the point (50) where the weldments (46) and (48) meet. Also, as shown in FIG. 2, the flexible containment system (30) is provided with a rigid plastic nozzle (68), which is secured to the top polyethylene sheet (34) by weldments or the like, and is in fluid communication with the second pocket (60). The nozzle (68) is not welded to nor secured to the inner polyethylene sheets (32) and (33), and is, therefore, not in fluid communication with the first pocket (58). (FIGS. 1-2).

Figure 3:
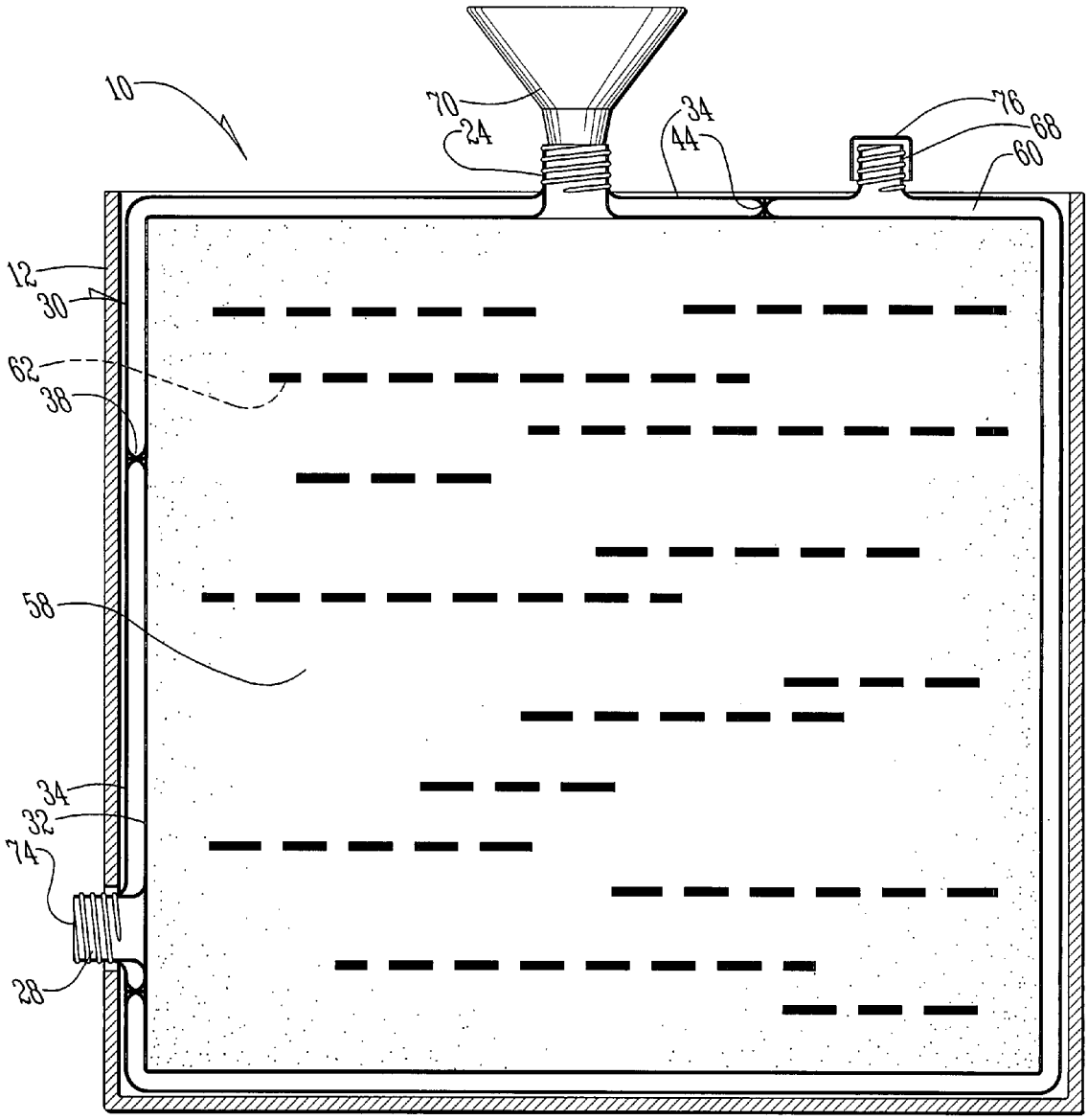
FIG. 3 illustrates a side elevation in cutaway of the container evacuation system of FIG. 1, shown with the container filled with material.

As shown in FIG. 3, whereas the nozzle (68) is in fluid communication with the second pocket (60), the inlet (24) is secured through the first polyethylene sheet (34) and to the inner polyethylene sheets (32) and (33), and is in fluid communication with the first pocket (58). Similarly, the drain (28) is provided through the first polyethylene sheet (34) and through the second and third inner polyethylene sheets (32) and (33), in fluid communication with the first pocket (58). Accordingly, when flowable material (62) is provided through the inlet (24) by a hopper (70) or evacuated from the first pocket (58) by an evacuation pump (72), the inlet.(24) and drain (28) do not allow the flowable material (62) to pass from the first pocket (58) to the second pocket (60). (FIGS. 3-4).

As shown in FIG. 3, when it is desired to fill the flexible containment system (30), the system (30) is positioned within the rigid container (12) and the drain (28) is provided with a threaded plug (74). Thereafter, flowable material (62) may either be heated or provided at ambient temperature through a hopper (70) or similar fill means through the inlet (24) and into the first pocket (58). As the first pocket (58) fills, the flowable material (62) forces the inner polyethylene sheet (32) against the outer polyethylene sheet (34), thereby reducing the volume of the second pocket (60). Once the first pocket (58) has been filled, a cap (76) is threaded onto the nozzle (68), the hopper (70) is removed from the inlet (24), and a threaded cap (78) is secured over the inlet (24) as shown in FIG. 4.

Once the container containment system (30) has been filled, the rigid container (12) may be transported or stored as desired. Once the rigid container (12) has reached its destination, or it is otherwise desired to remove some or all of the flowable material (62) from the flexible containment system (30), the threaded plug (74) is removed from the drain (28) an evacuation pump, such as those known in the art, is sealed over the drain (28). (FIGS. 1 and 4). Thereafter, a positive pressure of air is provided into the second pocket (60) through the nozzle (68), which is threadably secured to an air pump (80) by an air tube (82). The air pump (80) may be of any type known in the art, but is preferably of a type providing for an air pressure of between three and four thousand pascals, and most preferably about thirty-five hundred pascals, to be introduced into the second pocket (60) through the nozzle (68).

Figure 4:
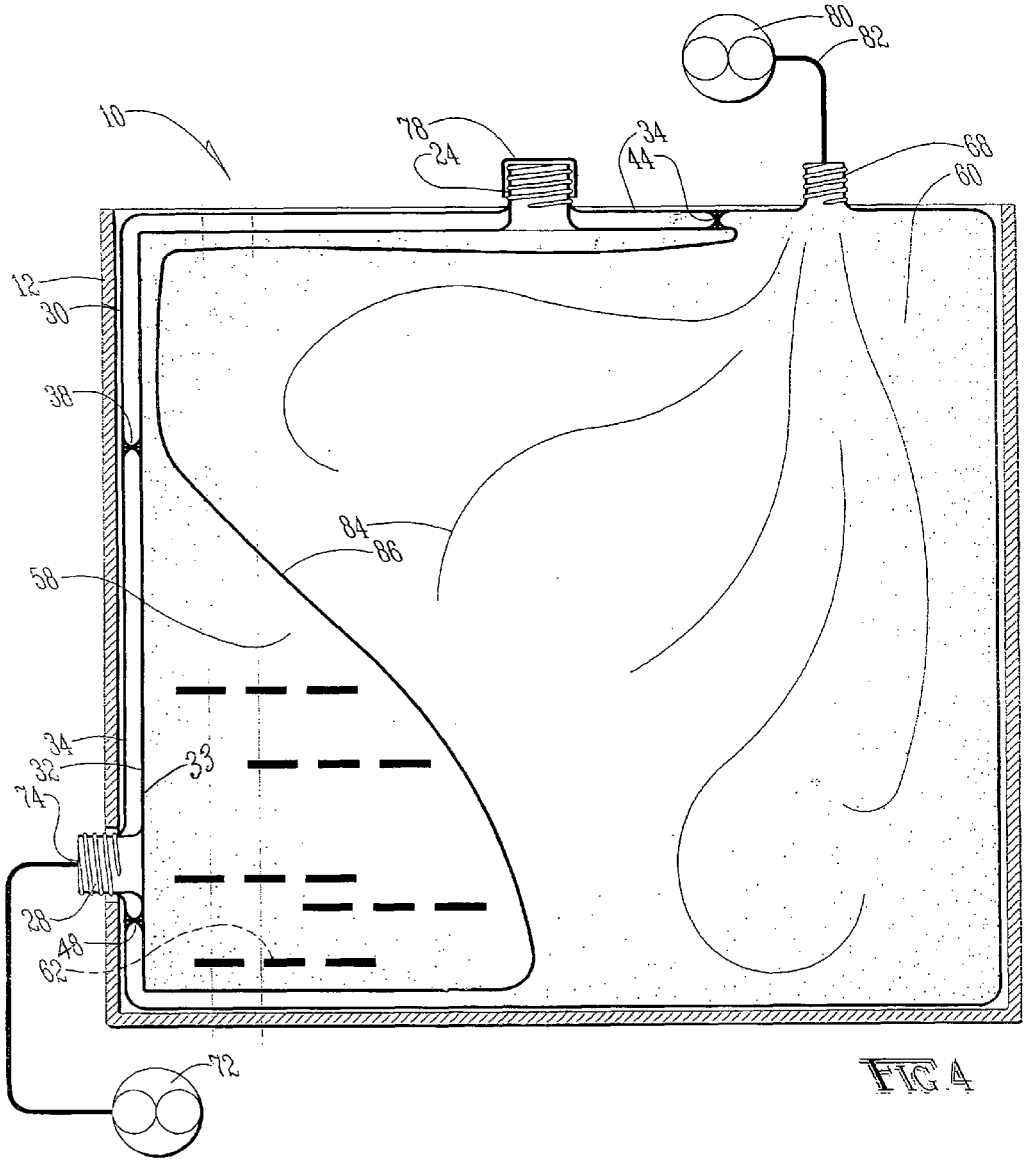
FIG. 4 illustrates a side elevation in partial cross-section of the container evacuation system of FIG. 1, shown with the second pocket partially filled with air and the first pocket partially evacuated of material.

As shown in FIG. 4, as air (84) enters and begins to fill the second pocket (60), the face (86) of the inner polyethylene sheet (33) forming the rearward inner face between the first pocket (58) and second pocket (60), acts as a follower plate to bias the flowable material (62) toward the evacuation pump (72) to prevent the evacuation pump (72) from cavitating as a result of the viscosity of the flowable material (62). If desired, the flowable material (62) may be heated to further aid in reducing the viscosity of the flowable material (62) and reducing the likelihood of cavitation of the evacuation pump (72).

Figure 5:
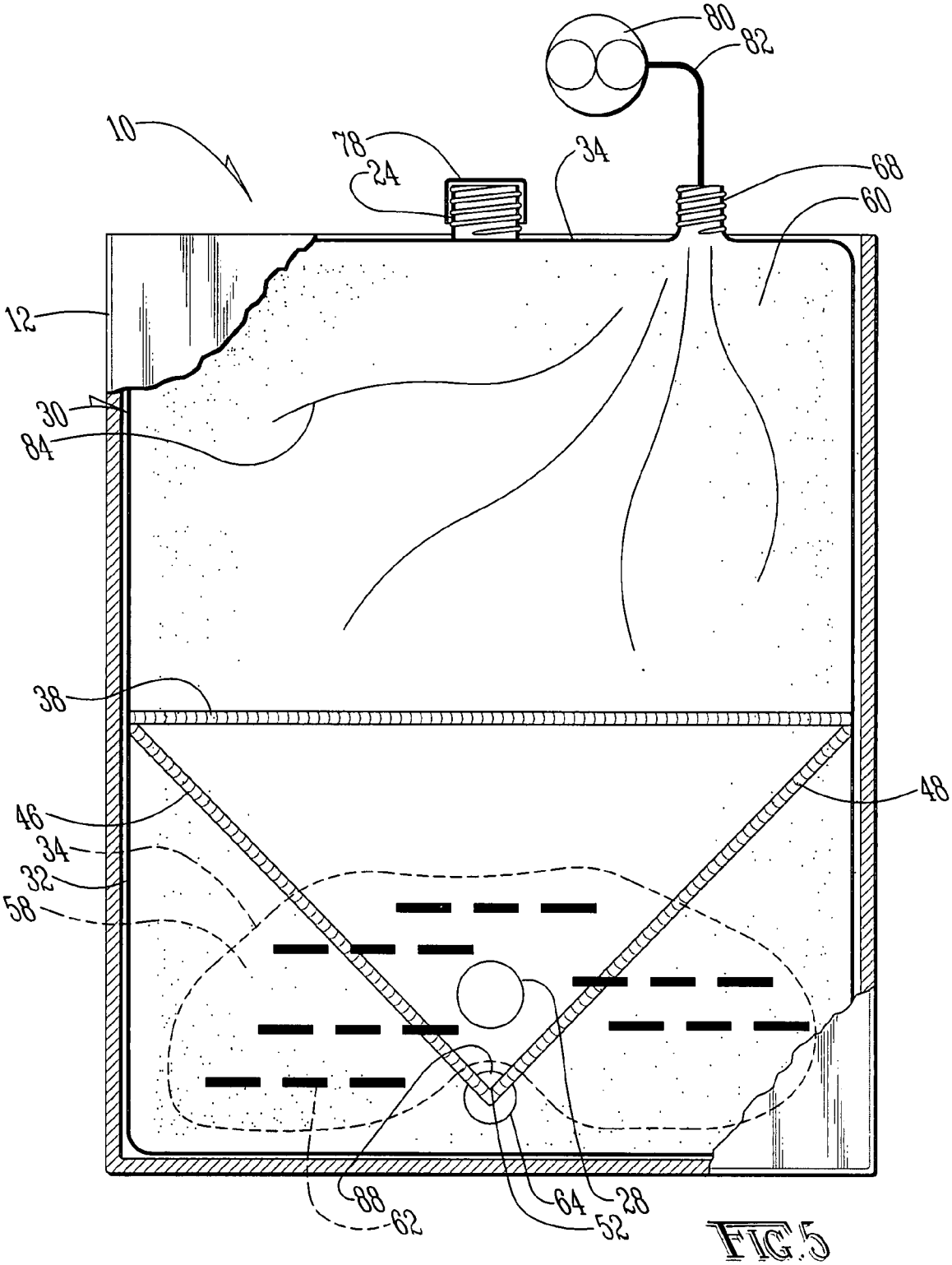
FIG. 5 illustrates a front elevation in partial cutaway and partial phantom of the container evacuation system of FIG. 1, shown with the second pocket partially filled with air and the first pocket partially evacuated of material.

As shown in FIG. 5, as the second pocket (60) becomes more filled with air (84) and the first pocket (58) becomes less filled with flowable material (62), the weldments (46), (48) and (64) forming the "V" weld (88), funnel the flowable material (62) toward the drain (28). Depending on the particular flowable material (62) utilized, the angle (52) between the weldments (46) and (48) varies to maximize the funneling of the flowable material (62) toward the drain (28), while reducing the likelihood of the face (86) of the inner polyethylene sheet (33) from forcing another portion of the flexible containment system (30) across the drain (28), and thereby halting or substantially reducing the evacuation of the flexible containment of the first pocket (58) by the evacuation pump (72).

Once the first pocket (58) has been sufficiently evacuated, the flexible containment system (30) may either be disposed of or returned to the producer for refilling. Similarly, the rigid container (12) may be destroyed or returned for refill. In the preferred embodiment, given the cost of the flexible containment system (30), it is desirable that upon evacuation of the flexible containment system (30) of a flowable material (62), such as grease, the flexible containment system (30) is thereafter discarded and only the rigid container (12) returned for refill. Given the extreme weight of prior art containers, such as steel framed containers, steel barrels and the like, the return cost associated with the rigid containers is substantially less, given the ability of the rigid containers (12) to fold flat and the inherent lightweight nature of their corrugated cardboard construction.

Although the invention has been described with respect to a preferred embodiment thereof, it is to be understood that it is not to be so limited since changes and modifications can be made therein which are within the full, intended scope of this invention as defined by the appended claims. For example, any desired number of pockets may be created using any desired number of sheets constructed of polyethylene or any other desired material. Additionally, the weldments may be more or less, or differently configured as long as at least a portion of the weldments preferably angles around the drain. The angle may be a sharp angle or a curve as desired.

What is claimed is:

1. A container system comprising:

(a) a flexible container comprising:

(i) a first flexible pocket;

(ii) a second flexible pocket coupled to said first flexible pocket and sealed from fluid communication with said first flexible pocket;

(iii) an inlet coupled to said first flexible pocket;

(iv) a drain coupled to said first flexible pocket; and (v) a fill port coupled to said second flexible pocket;

(b) a rigid frame provided in supporting engagement with said flexible container;

(c) wherein said first flexible pocket is secured to and within said second flexible pocket along a seam which curves around said drain (d) wherein said second flexible pocket is configured such that as a fluid is provided through said fill port, said first flexible pocket collapses and said second flexible pocket remains expanded;

(e) wherein said seam is located such that as said fluid is provided through said fill port, said fluid presses against said first flexible pocket, thereby forcing said first flexible pocket to evacuate a fluid through said drain;

(f) wherein said seam comprises a substantially straight first seam and substantially straight second seam, wherein said first seam is non-parallel to said second seam; and (g) wherein said first seam extends from a first position below said drain to a second position above said drain and wherein said second seam extends from a third position below said drain to a fourth position above said drain.

2. The container system of claim 1, wherein said seam further comprises a curved seam coupling said first seam to said second seam.

* * * * *